United States Patent [19]

Stephens et al.

[11] Patent Number: 4,458,299

[45] Date of Patent: Jul. 3, 1984

[54] MAGNETIC SWITCH

[75] Inventors: Arthur W. Stephens, Bordentown; John J. Penrose, Bordentown Township, Burlington County, both of N.J.

[73] Assignee: Princeton Tectonics, Bordentown, N.J.

[21] Appl. No.: 315,353

[22] Filed: Oct. 26, 1981

[51] Int. Cl.[3] ..... F21L 7/00

[52] U.S. Cl. ..... 362/158; 362/205; 362/267; 200/60

[58] Field of Search ..... 362/158, 205, 267; 200/60

[56] References Cited

U.S. PATENT DOCUMENTS

| | | | |
|---|---|---|---|
| 3,790,912 | 2/1974 | Murphy | 362/205 |
| 3,792,389 | 2/1974 | Murphy | 362/205 |
| 3,794,825 | 2/1974 | Krupansky | 362/158 |
| 3,798,440 | 3/1974 | Brindley | 362/158 |
| 4,152,755 | 5/1979 | Trosper et al. | 362/205 |

*Primary Examiner*—Stephen J. Lechert, Jr.
*Attorney, Agent, or Firm*—Sanford J. Asman

[57] ABSTRACT

The magnetic switch is a plastic unit which is made up of a housing containing three pieces, a slideable magnet holder, a bracket, and a plastic leaf spring. The magnet holder and the bracket include keys and notches to provide positive "on" and "off" positions. The housing is aligned with a mercury wetted switch which is capable of handling large current surges without being damaged, whereby the magnet holder is depressed against the spring bias and slid into either the "on" or the "off" position.

A hermetically sealed flashlight which includes the magnetic switch is also described. The flashlight comprises a case which is houses dry cells. A screw-on cap which includes a lens forms a hermetic seal when an O-ring is compressed as the cap is engaged.

A reflector mount is aligned with the case using a notch and key system which insures the alignment of the mercury wetted magnetic switch and the housing for the magnet holder.

3 Claims, 9 Drawing Figures

MAGNETIC SWITCH

BACKGROUND OF THE INVENTION

The present invention relates to an improvement in magnetic switches. In particular, the invention relates to a magnetic switch which is adapted to be used in applications where a hermetic seal is required.

Various types of magnetic switches have been used heretofore. Most of them employ two parts, one part typically includes a magnet, and the other part typically includes a magnetic reed switch. In operation, the magnetic reed switch typically is either normally open or normally closed when in the presence of a magnetic field. The opposite electrical condition occurs when the magnetic reed switch is removed from the magnetic field.

In the magnetic switches of the prior art, there has typically been no effort at providing for high current flow, or for providing a magnetic switch which is easily built into a device which must be hermetically sealed, i.e., an underwater flashlight. In addition, there has not been any means included within such switches for insuring that the magnet containing portion does not slip from the position into which it has been placed, nor has there been any effort at making such switches easily insertable into devices.

SUMMARY OF THE INVENTION

The present invention is an improved magnetic switch which may be locked either in the on or off position. The switch is easily included in devices which require such a switch. In addition, it may be subjected to high current surges without being damaged.

The invention can be used in a preferred embodiment in an underwater flashlight which is hermetically sealed.

DETAILED DESCRIPTION OF THE PREFERRED EMBODIMENTS

Figure 1:
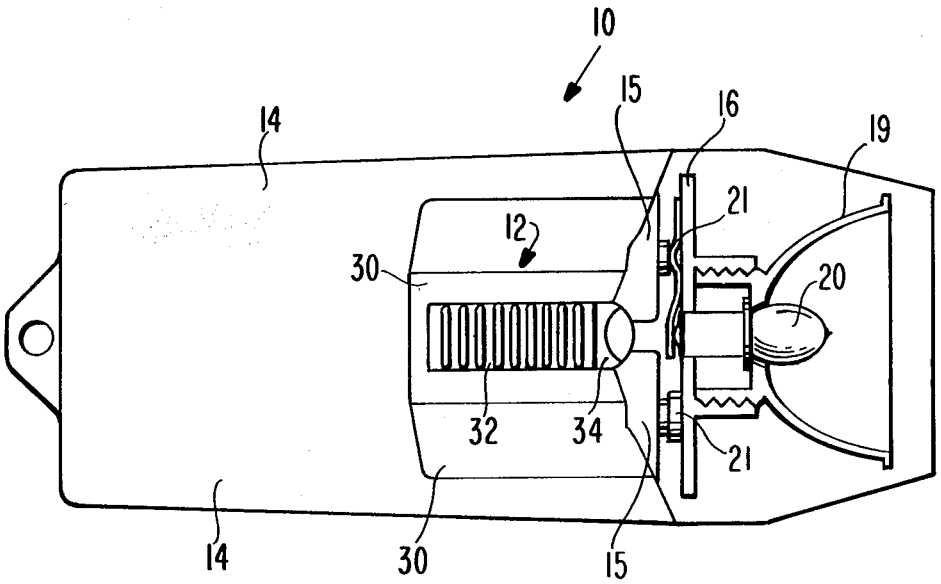
FIG. 1 is a top and partial cross-sectional view of an underwater flashlight containing the switch of the present invention.
Figure 2:
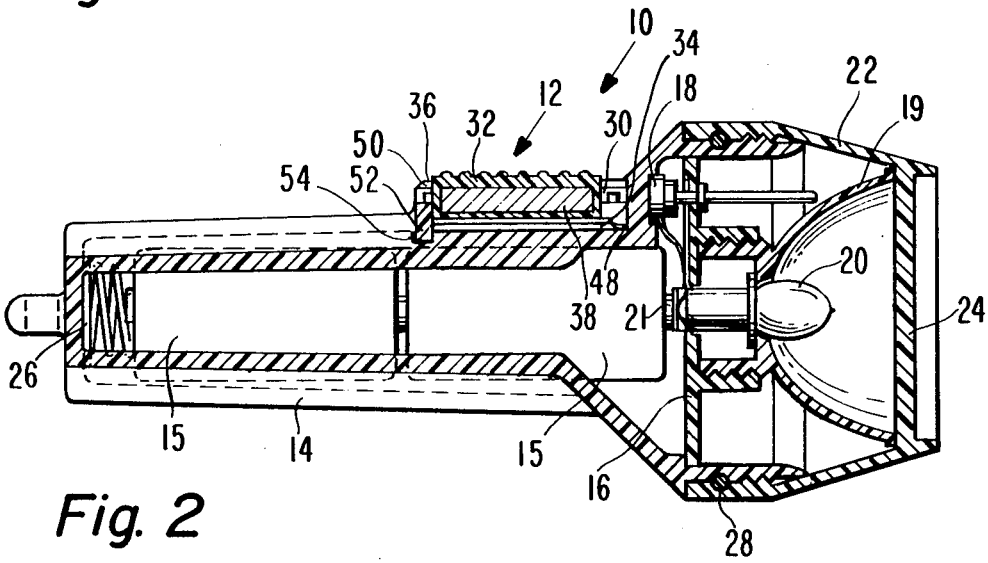
FIG. 2 is a cross-sectional side view of the underwater flashlight of FIG. 1.
Figure 3:
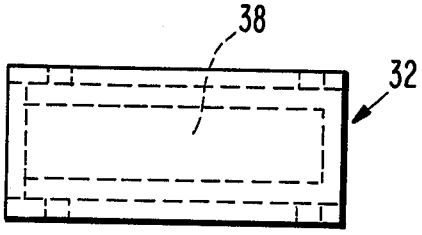
FIG. 3 is a bottom view of the magnet holder portion of the switch.

Referring to FIGS. 1 and 2, an underwater flashlight 10 which includes the magnetic switch 12 of the present invention, is shown. The underwater flashlight 10 includes a case 14 which is adapted to hold dry cells 15 which supply electric power. The case 14 is preferrably constructed of a material, such as a plastic, which can be molded to the desired shape, as shown. In the preferred embodiment of the invention, the case 14 is constructed of a polycarbonate plastic, such as Lexan which is a product of General Electric Corporation.

At one end of the case 14, there is a reflector base 16 through which is mounted a mercury wetted magnetic switch 18. By way of example, the LC-2 mercury wetted magnetic switch sold by the Fifth Dimension Corporation of Trenton, N.J., is used in the preferred embodiment of the invention.

The reflector base 16 also provides the means for mounting a reflector 19 which holds a flashlight tube 20. In the underwater flashlight 10 shown, the case 14 houses four 1.5 volt C cells. Accordingly, the flashlight bulb 20 is a 6 volt bulb. The reflector base 16 also includes means 21 for electrically contacting the electrode at one end of the cell 15 adjacent to it.

The reflector base 16 is held in position by a screw-on cap 22 which includes a transparent lens 24. Usually, the lens 24 will be clear. However, the lens 24 may be any desired color for particular applications. The reflector base 16, in turn, holds the dry cells 15 in the case 14. The dry cells 15 are biased out against the reflector base 16 by a spring 26 which is inside the case 14 at the end removed from the reflector base 16. The spring 26 also serves to interconnect the dry cells 15 in series. Finally, an O-ring 28 provides a hermetic seal when the cap 22 is screwed onto the open, threaded end of the case 14.

On top of the case 14 is a housing 30 which is adapted to hold the slideable portion of the magnetic switch 12 of the present invention. In the preferred embodiment of the invention, the slideable portion of the magnetic switch 12 is comprised of three parts, a magnet holder 32, shown particularly in FIGS. 3–6; a spring 34 shown in FIG. 7; and a mounting bracket 36, shown in FIGS. 8 and 9.

Referring now to FIGS. 3–6, the magnet holder 32 is a plastic piece which houses a rod-shaped magnet 38. The magnet holder 32 of the preferred embodiment of the invention has a ridged upper surface 40, whereby a user can easily move the magnet holder 32 in the housing 30, as will be explained more fully hereinafter. The magnet holder 32 of the preferred embodiment of the invention also includes shoulders 42, shown in FIGS. 4–6, which engage the mounting bracket 36, as will be explained more fully hereinafter. On either side of the magnet holder 32, molded into the shoulders 42, there are small keys 44 which engage notches 46 formed in the mounting bracket 36 (cf. FIGS. 8 and 9).

Figure 7:
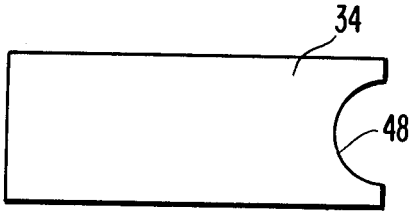
FIG. 7 is a top view of the leaf spring of the switch.
Figure 4:
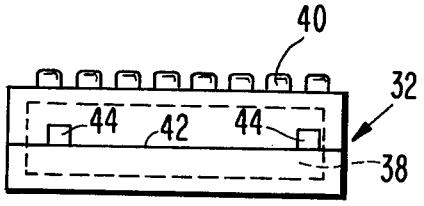
FIG. 4 is a side view of the magnet holder portion of the switch.

Referring to FIG. 7, the spring 34 of the preferred embodiment of the invention is a thin leaf spring constructed of a piece of Lexan. The spring 34 is substantially rectangular, but in the preferred embodiment of the invention, the spring 34 has a semicircular notch 48 formed at the end which will be adjacent to the end of the housing 30 adjacent to the reflector base 16.

Figure 9:
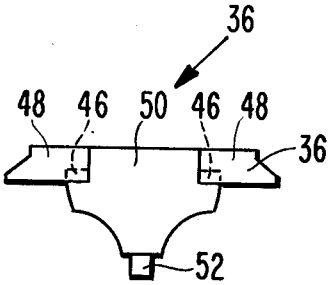
FIG. 9 is an end view of the mounting portion of the switch.
Figure 5:
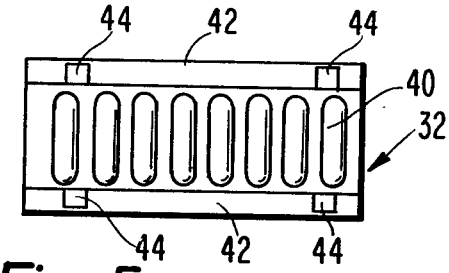
FIG. 5 is a top view of the magnet holder portion of the switch.
Figure 6:
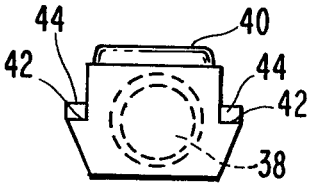
FIG. 6 is an end view of the magnet holder portion of the switch.
Figure 8:
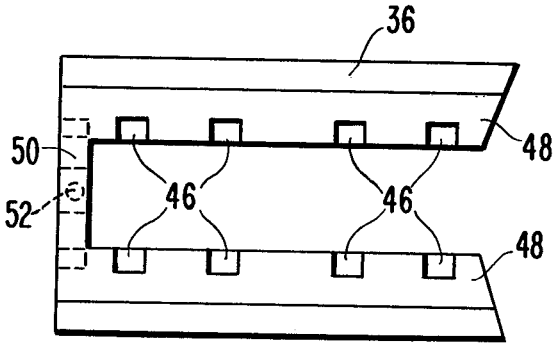
FIG. 8 is a top view of the mounting bracket of the switch.

The mounting bracket 36, illustrated in FIGS. 8 and 9, is also comprised of a piece of molded Lexan in the preferred embodiment of the invention. The mounting bracket 36 has a pair of parallel arms 48 which engage the shoulders 42 of the magnet holder 32. Notches 46 are formed in the arms 48, whereby the keys 44 on the shoulders 42 of the magnet holder 32 will engage the notches 46 in either of two positions, corresponding to the "on" and "off" positions of the switch 12. In those two positions, the leaf spring 34 urges the magnet holder 32 upward, thereby preventing the magnet holder 32 from sliding. Thus, the switch 12 has a well defined "on" position and a well defined "off" position. Thus the magnet holder 32 cannot slide from one position to the other position in the manner of the switches of the prior art.

Referring now to FIGS. 8 and 9, the arms 48 are joined at one end 50 of the mounting bracket 36. This end 50 includes a lock means 52 which holds the mounting bracket 36 in the housing 30 on the case 14 of the underwater flashlight 10. In addition, the lock means 52 prevents the spring 34 from coming out of the housing 30 when the switch is assembled. In the preferred embodiment of the invention, the lock means is comprised of a pin 52 which extends into a small depression 54 formed in the case 14 (cf. FIG. 1).

In order to assemble the slideable portion of the magnetic switch 12, the spring 34 is first placed into the housing 30 with its notched end away from the depression 54. The magnet holder 32 is aligned with the mounting bracket 36 such that the shoulder keys 44 are engaged in the notches 46 of the mounting bracket 36. The assembled magnet holder 32 and mounting bracket 36 are then pushed into the housing until the pin 52 of the mounting bracket 36 engages the depression 54 in the case 14. At that point, the mounting bracket 36 will lock into place in the housing 30.

When the switch 12 is assembled, the magnet holder 32 is biased upward by the spring 34 which is held in a flexed position by the magnet holder 32. Thus, the magnet holder 32 engages, via the keys 44 and the corresponding notches 46, in the "on" and "off" switch positions.

In use in an underwater flashlight 10, it was discovered that small particles, i.e., sand, could get wedged under the spring 34 and prevent it from flexing downward. Thus, it became impossible to push down on the magnet holder 32 in order to move the switch out of the detented "on" and "off" positions. It was discovered that by providing the semicircular notch 48 in the spring 34 water could flow under the spring 34 and out through the notch 48, thereby making the slideable portion of the switch 12 self cleaning.

Finally, by providing a notch and a matching key on the reflector base 16, the alignment of the mercury wetted magnetic switch 18 with the housing 30 is insured.

While the preferred embodiment of the magnetic switch of the present invention has been described with reference to a hermetically sealed flashlight 10, the magnetic switch 12 of the present invention can be utilized in numerous applications. Accordingly, the foregoing description is merely intended to illustrate a particular application of the present invention, which is intended to include various alternative applications to the one illustrated which would now be obvious to those of ordinary skill in the art. Similarly, while various keys and associated notches have been described herein, as will be obvious to those skilled in the art, the keys and notches on the magnet holder 32 and the mounting bracket 36 can be reversed as can the key and notch on the case 14 and the reflector base 16 without departing from the spirit or scope of the invention.

We claim:

1. A hermetically sealed flashlight comprising:

($a_1$) a mercury wetted magnetic switch;

($a_2$) a housing for a slideable magnet holder, said housing being adjacent to said mercury wetted magnetic switch;

($a_3$) a slideable magnet holder in said housing, said magnet holder holding a magnet;

($a_4$) means for retaining said slideable magnet holder within said housing while permitting said magnet holder within said housing while permitting said magnet holder to slide into a first position within said housing whereby the mercury wetted magnetic switch will close and a second position within said housing whereby the mercury wetted magnetic switch will open;

(b) a case for holding electric power cells, said case including a housing for the slideable portion of said switch;

(c) means for holding said mercury wetted magnetic switch adjacent to said housing;

(d) means for holding a light bulb in contact with said power cells; and (e) means for hermetically sealing said case.

2. The flashlight of claim 1 in which said means for holding said mercury wetted magnetic switch and said means for holding a light bulb comprises a reflector base.

3. The flashlight of claim 1 wherein said means for hermetically sealing said case comprises a screw-on cap and an O-ring.

* * * * *